US008182278B2

(12) United States Patent
Kataoka et al.

(10) Patent No.: US 8,182,278 B2
(45) Date of Patent: May 22, 2012

(54) CONNECTOR

(75) Inventors: Yuta Kataoka, Hitachi (JP); Hideaki Takehara, Hitachi (JP); Kunihiro Fukuda, Tsukuba (JP); Sachio Suzuki, Hitachi (JP); Jun Umetsu, Hitachi (JP); Shinya Hayashi, Hitachi (JP)

(73) Assignee: Hitachi Cable, Ltd., Tokyo (JP)

( * ) Notice: Subject to any disclaimer, the term of this patent is extended or adjusted under 35 U.S.C. 154(b) by 0 days.

(21) Appl. No.: 13/029,605

(22) Filed: Feb. 17, 2011

(65) Prior Publication Data

US 2011/0250801 A1 Oct. 13, 2011

(30) Foreign Application Priority Data

Apr. 12, 2010 (JP) ..... 2010-091579

(51) Int. Cl.
*H01R 11/22* (2006.01)

(52) U.S. Cl. ..... 439/266

(58) Field of Classification Search ..... 439/259, 439/262, 263, 265, 266, 268, 269.1
See application file for complete search history.

(56) References Cited

U.S. PATENT DOCUMENTS

| | | | | | |
|---|---|---|---|---|---|
| 1,917,009 | A | * | 7/1933 | Betts et al. | 439/262 |
| 2,744,968 | A | * | 5/1956 | Blackhall | 379/325 |
| 2,748,364 | A | * | 5/1956 | Kamm | 439/262 |
| 2,770,788 | A | * | 11/1956 | Eschner, Jr. | 439/262 |
| 2,932,810 | A | * | 4/1960 | Novak | 439/61 |
| 2,945,201 | A | * | 7/1960 | Waninger | 439/262 |
| 3,123,422 | A | * | 3/1964 | Mock | 439/292 |
| 3,504,100 | A | * | 3/1970 | Ohshima et al. | 174/88 B |
| 3,601,759 | A | * | 8/1971 | Barker | 439/262 |
| 3,891,289 | A | * | 6/1975 | Hanke | 439/106 |
| 3,941,446 | A | * | 3/1976 | Cantwell | 439/262 |
| 4,392,705 | A | * | 7/1983 | Andrews et al. | 439/342 |
| 5,219,292 | A | * | 6/1993 | Dickirson et al. | 439/67 |
| 5,322,447 | A | * | 6/1994 | Okada | 439/79 |
| 5,334,029 | A | * | 8/1994 | Akkapeddi et al. | 439/66 |
| 5,741,148 | A | * | 4/1998 | Biernath | 439/284 |
| 5,827,084 | A | * | 10/1998 | Biernath | 439/262 |
| 6,113,436 | A | | 9/2000 | Kuwahara et al. | |

(Continued)

FOREIGN PATENT DOCUMENTS

JP A-S63-190269 8/1988

(Continued)

*Primary Examiner* — Ross Gushi
(74) *Attorney, Agent, or Firm* — Scully, Scott, Murphy & Presser, P.C.

(57) ABSTRACT

A connector includes a first terminal housing for housing a plurality of aligned first connecting terminals, a second terminal housing for housing a plurality of aligned second connecting terminals, and a connecting member for collectively fixing and electrically connecting the plurality of first connecting terminals and the plurality of second connecting terminals. The insulator includes a first insulating member that is one of two divided insulators formed by dividing the insulator, and a second insulating member that is another of the divided insulators. The two divided insulators overlap when the first terminal housing is fitted to the second terminal housing, thereby forming the insulator having a predetermined thickness. A fitting groove is formed on a facing surface of one of the first and second insulating members, and a convex portion fitting to the fitting groove is formed on a facing surface of the other.

8 Claims, 7 Drawing Sheets

U.S. PATENT DOCUMENTS

| | | | | |
|---|---|---|---|---|
| 6,431,876 | B1 * | 8/2002 | Svenkeson et al. | 439/67 |
| 6,508,674 | B1 * | 1/2003 | Svenkeson et al. | 439/631 |
| 6,551,113 | B1 * | 4/2003 | Nishiyama et al. | 439/67 |
| 6,699,395 | B1 * | 3/2004 | Svenkeson et al. | 216/13 |
| 7,470,154 | B2 | 12/2008 | Sato | |
| 2008/0102710 | A1 | 5/2008 | Sato | |
| 2009/0075506 | A1 | 3/2009 | Suzuki | |

FOREIGN PATENT DOCUMENTS

| | | |
|---|---|---|
| JP | A-2000-3750 | 1/2000 |
| JP | A-2001-203021 | 7/2001 |
| JP | A-2004-056924 | 2/2004 |
| JP | A-2008-108675 | 5/2008 |
| JP | A-2009-070754 | 4/2009 |

* cited by examiner

5 FIRST TERMINAL HOUSING
7 SECOND TERMINAL HOUSING
9 CONNECTING MEMBER
43b-45b SECOND INSULATING MEMBER

5 FIRST TERMINAL HOUSING
7 SECOND TERMINAL HOUSING
9 CONNECTING MEMBER
43a-46a FIRST INSULATING MEMBER
43b-45b SECOND INSULATING MEMBER
55 FITTING GROOVE
57 CONVEX PORTION 4a-4c FIRST CONNECTING TERMINAL
5 FIRST TERMINAL HOUSING
43a-46a FIRST INSULATING MEMBER
55 FITTING GROOVE 6a-6c SECOND CONNECTING TERMINAL
7 SECOND TERMINAL HOUSING
43b-45b SECOND INSULATING MEMBER
57 CONVEX PORTION

CONNECTOR

The present application is based on Japanese Patent Application No. 2010-091579 filed on Apr. 12, 2010, the entire contents of which are incorporated herein by reference.

BACKGROUND OF THE INVENTION

1. Field of the Invention

The invention relates to a connector which is used for, e.g., an eco-friendly car such as a hybrid car and an electric car, in particular, to a connector which may be potentially employed for a connection of a power harness used for transmitting a large amount of power.

2. Description of the Related Art

A power harness has made significant progress in recent years and is used for connecting between devices such as between a motor and an inverter or between an inverter and a battery in, e.g., a hybrid car or an electric car for transmitting a large amount of power, and a connector in a two-divided structure composed of e.g., a male connector portion provided with a male terminal as well as a first terminal housing for housing the male terminal and a female connector portion provided with a female terminal connected to the male terminal as well as a second terminal housing for housing the female terminal is provided to one end of the power harness (see, e.g., JP-A-2009-070754).

In recent years, all components in such an eco-friendly car have been lightened in weight in order to improve energy saving performance, and size reduction is desired as one of effective means of reducing weight.

A technique of Japanese patent No. 4037199 is an example of a known technique.

The technique described in Japanese patent No. 4037199 is an electric connection structure for vehicle in which connecting terminals of plural phases of a conductive member led from a vehicle driving motor are connected to connecting terminals of plural phases of a power line cable led from an inverter for driving the motor, a connecting terminal of each phase of the conductive member overlaps a corresponding connecting terminal of each phase of the power line cable, an insulating member is arranged on a surface opposite to an overlapping surface of the connecting terminals, and the overlapped terminals of each phase are tightened and fixed to the insulating member in an overlapping direction by a single bolt provided at a position to penetrate therethrough.

In other words, the technique of Japanese patent No. 4037199 is a connection structure in which plural connecting terminals and insulating members compose a laminated structure and the connecting terminals are fixed and electrically connected all together at contact points by tightening in an overlapping direction (or a lamination direction) using a single bolt while plural contact points between the connecting terminals as an overlapping surface thereof are sandwiched, and this kind of configuration is more effective than the technique of JP-A-2009-070754 in that downsizing is easy.

SUMMARY OF THE INVENTION

In the technique of Japanese patent No. 4037199, the connecting terminals are fixed and electrically connected by a bolt, i.e., a through type connecting member (a stem portion and ahead portion), as mentioned above. Since the through-type connecting member is formed of metal in light of strength, it is necessary to ensure insulation at a stem portion which penetrates contact points and a collar is thus separately provided to cover a periphery of the stem portion, however, this configuration has a problem that the number of components used for the connecting member increases, resulting in high cost.

Therefore, in order to decrease the number of components used for the connecting member and to reduce the cost, the inventors designed a configuration such that a connecting member is formed not in a through-type but in a non-through type by using only a head portion and that an adjacent insulating member is pushed from one direction by the head portion of the connecting member to fix and electrically connect connecting terminals at each contact point.

However, a power harness used for a vehicle is used in an environment such as in a vehicle where vibration is likely to occur, and when the above-mentioned non-through type connecting member is used, connecting terminals move relatively easily due to fine sliding as compared to the case of using a through-type connecting member, and thus, a problem of abrasion at a contact point arises. For example, although tin plating, etc., is applied to a surface of the connecting terminal in order to stably obtain low contact resistance, when the connecting terminal is abraded due to fine sliding, the tin plating on the surface of the connecting terminal is peeled off, abrasion powder is generated, is oxidized and is deposited, and the connecting terminal climes on the oxidized abrasion powder, resulting in an increase in contact resistance.

Therefore, when the non-through type connecting member is employed, there is a new problem that it is necessary to take measures to prevent abrasion at the contact point.

The invention is made in view of the above-mentioned circumstances, and it is an object of the invention to provide a connector in which plural first connecting terminals, plural second terminals and plural insulators are arranged in a laminated state, and it is possible to suppress abrasion at a contact point due to fine sliding.

(1) According to one embodiment of the invention, a connector comprises:

a first terminal housing for housing a plurality of aligned first connecting terminals;

a second terminal housing for housing a plurality of aligned second connecting terminals;

a laminated structure that one surface of each of the plurality of first connecting terminals is paired with one surface of each of the plurality of second connecting terminals to form a plurality of contact points when the first terminal housing is fitted to the second terminal housing and each contact point is arranged so as to be sandwiched by insulators having a predetermined thickness; and a connecting member for collectively fixing and electrically connecting the plurality of first connecting terminals and the plurality of second connecting terminals at each contact point by pressing the insulator adjacent thereto, wherein the insulator comprises a first insulating member that is one of two divided insulators formed by dividing the insulator, the first insulating member being formed so as to be fixed to another surface of the first connecting terminal adjacent thereto and to cover at least an end surface of the adjacent first connecting terminal on a front end side in a fitting direction, and a second insulating member that is another of the divided insulators, the second insulating member being formed so as to be fixed to another surface of the second connecting terminal adjacent thereto and to cover at least an end surface of the adjacent second connecting terminal on a front end side in a fitting direction, the two divided insulators overlap when the first terminal housing is fitted to the second terminal housing, thereby forming the insulator having a predetermined thickness, and a fitting groove is formed on a facing surface of one of the first and second insulating members that face each other by the overlap of the two divided insulators, and a convex portion fitting to the fitting groove is formed on a facing surface of the other.

(2) According to another embodiment of the invention, a connector comprises:

a first terminal housing for housing a plurality of aligned first connecting terminals;

a second terminal housing for housing a plurality of aligned second connecting terminals;

a plurality of aligned insulators housed in the first terminal housing;

a laminated state that one surface of each of the plurality of first connecting terminals faces one surface of each of the plurality of second connecting terminals so as to be paired when the first terminal housing is fitted to the second terminal housing and the plurality of insulators are arranged so that each of a plurality of contact points formed by a plurality of facing first and second connecting terminals are sandwiched therebetween; and a connecting member for collectively fixing and electrically connecting the plurality of first connecting terminals and the plurality of second connecting terminals at each contact point by pressing the insulator adjacent thereto is included, wherein each of the plurality of first connecting terminals is integrally fixed to an insulator that is adjacently arranged on another surface, and a fitting groove is formed on one of another surface of the second connecting terminal and a surface of the insulator that face each other at the time of fitting the first terminal housing to the second terminal housing, and a convex portion fitting to the fitting groove is formed on the other.

In the above embodiment (1) or (2) of the invention, the following modifications and changes can be made.

(i) The fitting groove is formed in a triangular shape such that a groove width increases toward a front end side in a fitting direction, the convex portion is formed such that a width decreases toward the front end side in the fitting direction so as to be fitted to the triangular fitting groove, and the fitting groove is gradually fitted into the convex portion as the first terminal housing is being fitted to the second terminal housing.

(ii) A protruding engaging portion is formed on a surface of the convex portion, and an engaging hole to be engaged with the engaging portion is formed on a bottom surface of the fitting groove.

Points of the Invention

According to one embodiment of the invention, a connector is constructed such that a fitting groove is formed on one of facing surfaces of a first insulating member and a second insulating member which face each other when two divided insulators (i.e., a first insulating member and a second insulating member) are overlapped, and a convex portion fitted to the fitting groove is formed on the another facing surface. Thereby, it is possible to restrict movement of each insulating member and to suppress abrasion due to fine sliding at the contact points while ensuring insertability between connecting terminals when the connector is fitted even if a non-through type connecting member is employed.

BRIEF DESCRIPTION OF THE DRAWINGS

Next, the present invention will be explained in more detail in conjunction with appended drawings, wherein:

FIGS. 4A and 4B show the first connector portion, wherein FIG. 4A is a cross sectional view thereof and FIG. 4B is a schematic view thereof when viewed from a front end side in a fitting direction;

FIGS. 5A and 5B show a first connecting terminal, wherein FIG. 5A is aside view thereof and FIG. 5B is a top view thereof;

FIGS. 6A and 6B show the second connector portion, wherein FIG. 6A is a cross sectional view thereof and FIG. 6B is a schematic view thereof;

FIGS. 7A and 7B show a second connecting terminal, wherein FIG. 7A is a side view thereof and FIG. 7B is a bottom view thereof;

FIGS. 8A and 8B show the second connecting terminal, wherein FIG. 8A is a side view and FIG. 8B is a top view;

FIGS. 9A to 9D show the second connecting terminals which are aligned and held in a second inner housing, wherein FIG. 9A is a perspective view thereof, FIG. 9B is a top view thereof, FIG. 9C is a bottom view thereof and FIG. 9D is a side view thereof;

FIGS. 11A and 11B show a second connecting terminal in the connector of FIG. 10, wherein FIG. 11A is a side view thereof and FIG. 11 is a bottom view thereof.

DETAILED DESCRIPTION OF THE PREFERRED EMBODIMENTS

A preferred embodiment of the invention will be described below in conjunction with the appended drawings.

Figure 1:
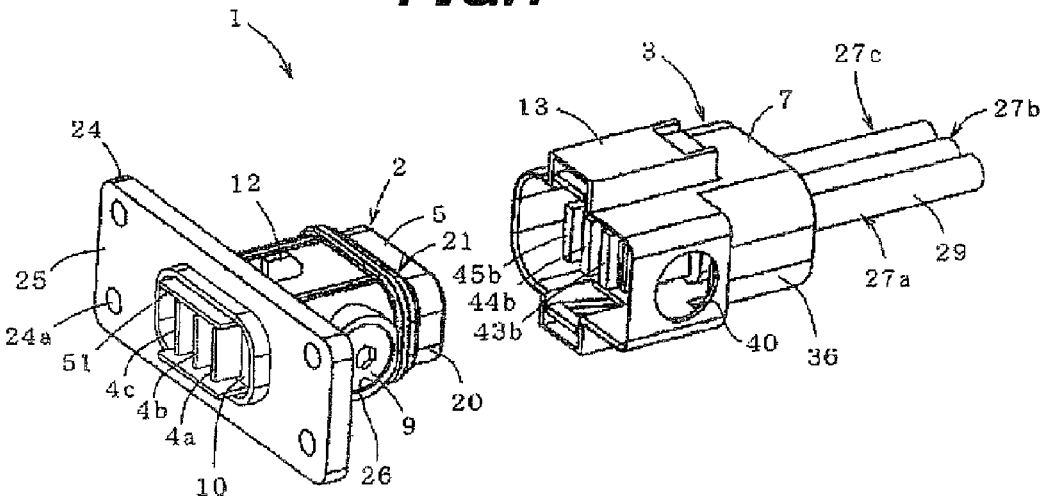
FIG. 1 is a perspective view showing first and second connector portions which compose a connector in an embodiment of the present invention.
Figure 2:
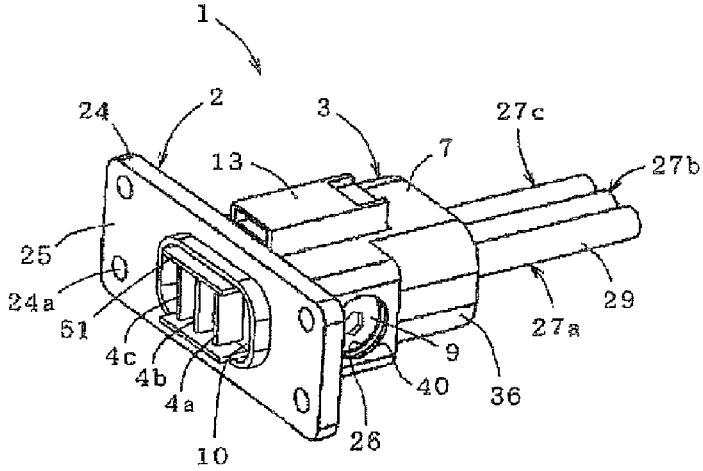
FIG. 2 is a perspective view showing the connector after the first connector portion is fitted to the second connector.
Figure 3:
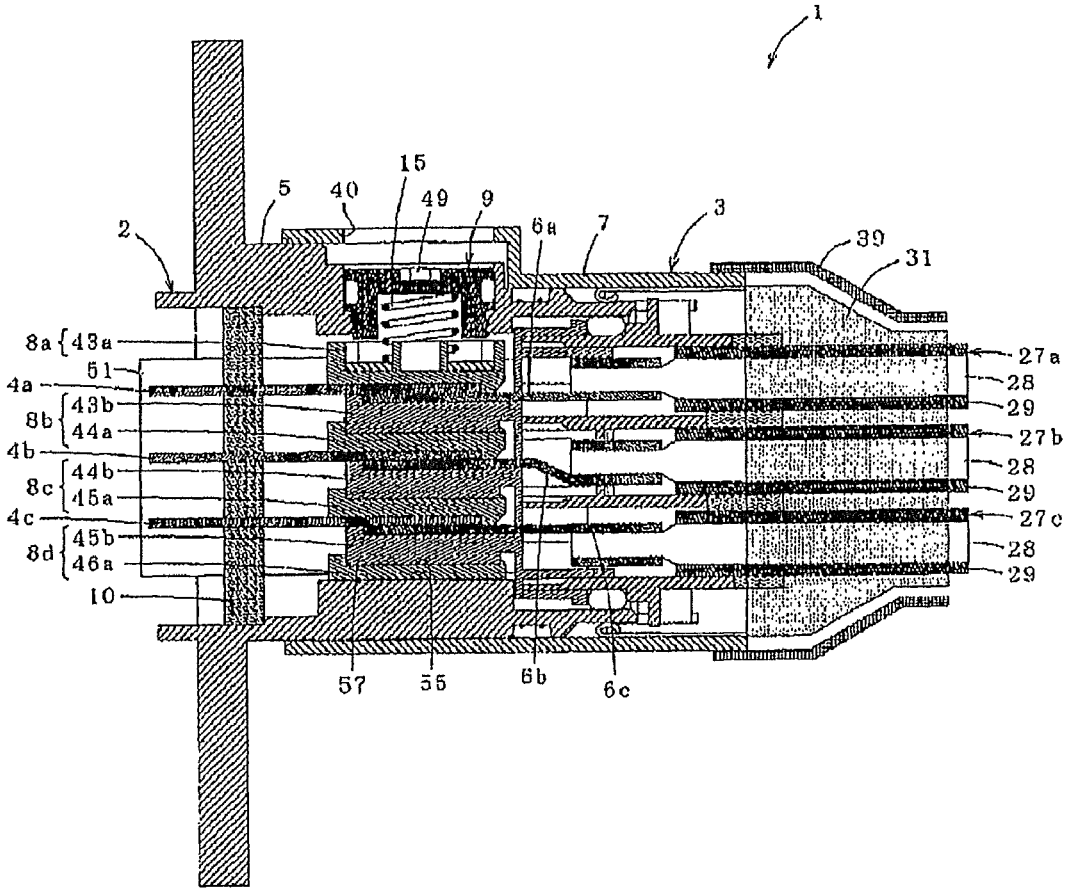
FIG. 3 is a cross sectional view showing the connector after the first connector portion is fitted to the second connector.

FIG. 1 is a perspective view showing first and second connector portions of a connector in the present embodiment, FIG. 2 is a perspective view showing the connector when the first connector portion is fitted to the second connector, and FIG. 3 is a cross sectional view thereof.

As shown in FIGS. 1-3, a connector 1 of the present embodiment is composed of a first connector portion 2 and a second connector portion 3, and plural power lines are connected at a time by fitting the connector portions 2 and 3 together.

More specifically, the connector 1 is provided with the first connector portion 2 having a first terminal housing 5 which houses plural (three) aligned first connecting terminals (male terminals) 4*a*-4*c*, the second connector portion 3 having a second terminal housing 7 which houses plural (three) aligned second connecting terminals (female terminals) 6*a*-6*c*, plural insulators 8*a*-8*d* for insulating between contact points, and a connecting member 9 for collectively fixing and electrically connecting the plural first connecting terminals 4*a*-4*c* to the plural second connecting terminals 6*a*-6*c* at each contact point by pressing the insulator 8*a* adjacent thereto. In the connector 1, when the first terminal housing 5 of the first connector portion 2 is fitted to the second terminal housing 7 of the second connector portion 3, one surface of each of the plural first connecting terminals 4*a*-4*c* is paired with one surface of each of the plural second connecting terminals 6*a*-6*c* (a pair of the first connecting terminal 4*a* and the second connecting terminal 6*a*, that of the first connecting terminal 4*b* and the second connecting terminal 6*b*, and that the first connecting terminal 4*c* and the second connecting terminal 6*c*) to compose plural contact points and each contact point is arranged so as to be sandwiched by the insulators 8*a*-8*d* formed of a non-conductive resin with a predetermined thickness, thereby forming a laminated structure.

The insulators 8*a*-8*d* are composed of two divided insulators, first insulating members 43*a*-46*a* and second insulating members 43*b*-45*b*. More precisely, the insulator 8*a* has the same thickness as the first insulating member 43*a* and is not divided in the present embodiment, but may have a thickness of the first insulating members 44*a*-46*a* which are divided. The insulator 8*a* as a divided insulator is explained below.

The first insulating members 43*a*-46*a* are one of the two divided insulators which are formed by diving the insulators 8*a*-8*d*. When the first connecting terminal 4*a* (or 4*b* or 4*c*) is adjacent thereto, the first insulating members 43*a*-46*a* are fixed to another surface of the adjacent first connecting terminal 4*a* (or 4*b* or 4*c*) so as to cover at least an end surface of thereof on a front end side in a fitting direction. The first insulating member 46*a* not having the adjacent first connecting terminal 4*a* (or 4*b* or 4*c*) is integrally fixed to an inner surface of the first terminal housing 5.

The second insulating members 43*b*-45*b* are another of the divided insulators. When the second connecting terminal 6*a* (or 6*b* or 6*c*) is adjacent thereto, the second insulating members 43*b*-45*b* are fixed to another surface of the adjacent second connecting terminal 6*a* (or 6*b* or 6*c*) so as to cover at least an end surface thereof on a front end side in a fitting direction.

The first insulating member 44*a* (or 45*a* or 46*a*, or alternatively 43*a*) and the second insulating member 43*b* (or 44*b* or 45*b*) are formed so that the total thickness thereof is necessary and sufficient to ensure insulation between the contact points (or between a contact point and the first terminal housing). In other words, the insulation between the contact points (or between a contact point and the first terminal housing) can be ensured only by overlapping the first insulating members 43*a*-46*a* with the second insulating members 43*b*-45*b*.

As described above, the reason why the insulators 8*a*-8*d* are composed of two divided insulators, the first insulating members 43*a*-46*a* and the second insulating members 43*b*-45*b*, is to obtain a structure, so-called touch protection, for preventing a foreign object such as a hand or a finger from touching the first connecting terminals 4*a*-4*c* and the second connecting terminals 6*a*-6*c* when the first terminal housing 5 is not fitted to the second terminal housing 7.

The insulator 8*a* pressed by the connecting member 9 is actually formed of only the first insulating member 43*a*, however, from the viewpoint of the idea of the present invention, it may be said that the insulator 8*a* is formed by overlapping the first insulating member 43*a* having a predetermined thickness with a second insulating member having a thickness of zero.

The connector 1 is used for connecting, e.g., a motor for driving a vehicle to an inverter for driving the motor.

More specifically, the first terminal housing 5 of the first connector portion 2 (on the left side in FIG. 1) is fitted to a shield case of the motor, and portions of the first connecting terminals 4*a*-4*c* exposed from the first terminal housing 5 are connected to each terminal of a terminal block which is installed in the shield case of the motor. The second connector portion 3 electrically connected to the inverter is fitted to the first connector portion 2, thereby electrically connecting the motor to the inverter. The above is the connection on the motor side, and the connection on the inverter side is the same.

Each configuration of the connector portions 2 and 3 will be described in detail below.

Figure 4A:
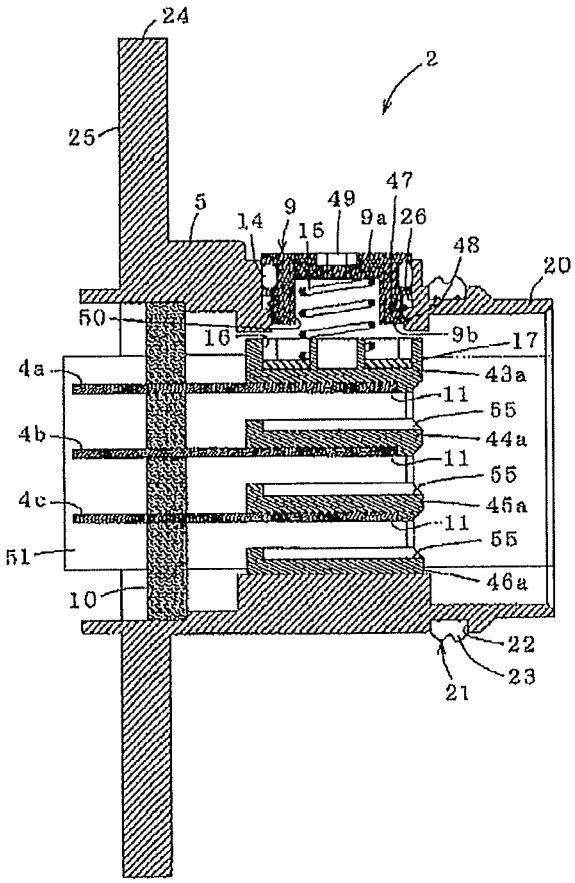
Figure 4B:
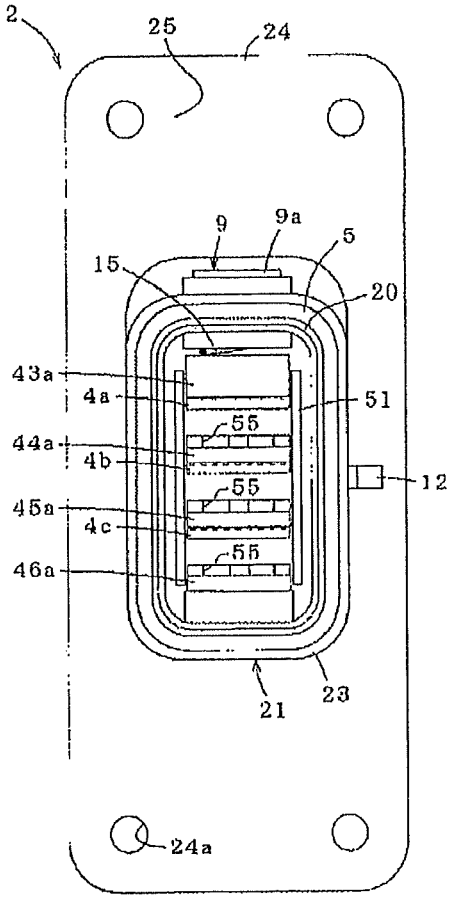

As shown in FIG. 4, in the first connector portion 2, three first connecting terminals 4*a*-4*c* are aligned and held at predetermined intervals, and the first terminal housing 5 housing the three aligned first connecting terminals 4*a*-4*c* and the connecting member 9 for collectively fixing and electrically connecting the plural first connecting terminals 4*a*-4*c* to the plural second connecting terminals 6*a*-6*c* at each contact point by pressing the adjacent insulator 8*a* are provided.

As a terminal housing, the first terminal housing 5 may be either male (a male terminal housing) or female (a female terminal housing). Here, the case where the first terminal housing 5 is a male terminal housing will be explained as an example.

The first connecting terminals 4*a*-4*c* are plate-like terminals, are formed of non-conductive resin (e.g., PPS (polyphenylene sulfide) resin, PPA (polyphthalamide) resin, PA (polyamide) resin, PBT (polybutylene terephthalate) and epoxy-based resin), and are aligned and held at predetermined intervals in a first inner housing 10 which is housed in the first terminal housing 5 and is formed of a resin molded body. The method of holding the first connecting terminals 4*a*-4*c* in the first inner housing 10 includes a holding method in which the first connecting terminals 4*a*-4*c* are inserted at the time of forming the first inner housing 10 and a resin is subsequently cured, and a holding method in which the first connecting terminals 4*a*-4*c* are pressed into the preliminarily formed first inner housing 10.

In addition, each of the first connecting terminals 4*a*-4*c* is integrally fixed to the first insulating members 43*a*-45*a* which are adjacently arranged on the other surface side (a surface opposite to the surface connected to the second connecting terminals 6*a*-6*c*). That is, as mentioned above, the first inner housing 10 holds the first connecting terminals 4*a*-4*c* aligned at predetermined intervals and the first insulating members 43*a*-45*a* are integrally fixed at the end of the held first connecting terminals 4*a*-4*c*, and as a result, the first insulating members 43*a*-45*a* are also aligned at predetermined intervals. Such a configuration ensures insulation between each contact point and insertability of the second connecting terminals 6*a*-6*c* for the fitting.

Note that, it is not necessary to physically fix the first insulating members 43*a*-45*a* to the first connecting terminals 4*a*-4*c*, and it is enough if a positional relationship between the first insulating members 43*a*-45*a* and the first connecting terminals 4*a*-4*c* is fixed. The positional relationship between the first insulating members 43*a*-45*a* and the first connecting terminals 4*a*-4*c* is fixed by, e.g., integrally forming the first insulating members 43*a*-45*a* with the first inner housing 10. As described above, it is possible to cut the number of components and processes for forming the components by integrally forming the first insulating members 43*a*-45*a* with the first inner housing 10, thereby further reducing the manufacturing cost.

Electricity of different voltage and/or current is fed to each of the first connecting terminals 4*a*-4*c*. For example, the present invention assumes the use of a three-phase AC power line between a motor and an inverter, and alternate current different by 120 degrees in phase is fed to each of the first connecting terminals 4*a*-4*c*. Each of the first connecting terminals 4*a*-4*c* should be formed of a highly conductive metal such as silver, copper or aluminum for reducing the electric power transmission loss, etc., in the connector 1. In addition, each of the first connecting terminals 4*a*-4*c* has little flexibility.

Figure 5A:
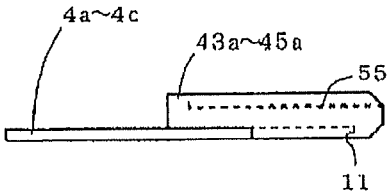

The first insulating members 43*a*-45*a* are positioned and fixed so as to protrude on the front end side of the first connecting terminals 4*a*-4*c*. A corner of each of the first insulating members 43*a*-45*a* on a side to insert and extract the second connecting terminals 6*a*-6*c* is chamfered. In addition, a fitting groove 11 for fitting the first connecting terminals 4*a*-4*c* to be fixed is formed on the first insulating members 43*a*-45*a* as shown in FIG. 5A. The first connecting terminals 4*a*-4*c* to be fixed are fitted and integrally fixed to the fitting groove 11. As a result, the end surface of the first connecting terminals 4*a*-4*c* on the front end side in the fixing direction is covered, a level difference between the first insulating members 43*a*-45*a* and the first connecting terminals 4*a*-4*c* is filled, and a back surface of the first insulating members 43*a*-45*a* (a lower surface in the drawing) is thereby flush with the back surface of the first connecting terminals 4*a*-4*c* (a lower surface in the drawing). These configurations improve the insertion and extraction properties of the second connecting terminals 6*a*-6*c* into and from the first connecting terminals 4*a*-4*c* since the second connecting terminals 6*a*-6*c* do not contact with the end surface of the first connecting terminals 4*a*-4*c* when the first connector portion 2 is fitted to the second connector portion 3. It should be noted that, in FIG. 5A, the structure of the first insulating member 43*a* is simplified and the first insulating members 43*a*-45*a* are illustrated in the same figure.

Figure 5B:
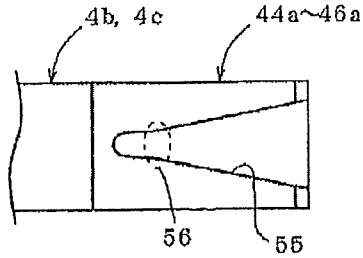

Meanwhile, a fitting groove 55 is formed on the upper surfaces of the first insulating members 44*a*-46*a* as shown in FIG. 5B. The fitting groove 55 is formed in a substantially triangular shape of which groove width increases toward the front end side in the fitting direction. Furthermore, a necked portion 56, at which a groove width increase rate changes, is formed on a rear end side of the fitting groove 55 in the fitting direction. In detail, it is formed such that the groove width increase rate on the front end side in the fitting direction is larger than the rear end side in the fitting direction across the necked portion 56. In other words, the fitting groove 55 has a shape which is narrowed on the rear end side in the fitting direction. It should be noted that the first insulating members 44*a*-46*a* are illustrated in the same figure in FIG. 5B for convenience of explaining the fitting groove 55 even though a second connecting terminal is not to be connected to the first insulating member 46*a*.

Referring once again to FIG. 4, the connecting member 9 is metal (e.g., SUS, iron and a copper alloy, etc.), and is a non-through type connecting member formed of a head portion which has a large diameter portion 9*a* and a small diameter portion 9*b* integrally formed with the large diameter portion 9*a*.

A packing 14 for preventing water from entering into the first terminal housing 5 is provided on the outer periphery of the large diameter portion 9*a*.

A male screw 48, which is joined together with a female screw 47 formed on an inner peripheral surface of a connecting member insertion hole 26 of the first terminal housing 5, is formed on an outer periphery of the small diameter portion 9*b*. Such a configuration makes the connecting member 9 press the insulator 8*a* adjacent thereto by screwing together with the first terminal housing 5.

An irregular shaped hole 49 (a hexagonal hole in FIG. 4A) is formed on the upper surface of the large diameter portion 9*a*, and the connecting member 9 can be rotated and tightened by fitting a tightening tool such as a spanner to the irregular shaped hole 49.

Meanwhile, the connecting member 9 is formed in a shape having two outer diameter dimensions, one of which is the large diameter portion 9*a* provided with the packing 14 and another of which is the small diameter portion 9*b* having the male screw 48 formed thereon, and the connecting member insertion hole 26 is formed in a shape which matches the shape having two outer diameter dimensions. An effective waterproof structure can be realized by such a configuration, i.e., by not arranging the male screw 48 at a portion facing the packing 14 when the connecting member 9 is tightened against the connecting member insertion hole 26.

In addition, the connecting member 9 has a hollow portion 50 which opens in the first terminal housing 5 and houses an elastic member 15 for imparting a predetermined pressing force to the insulator 8*a*. The elastic member 15 is composed of, e.g., a spring formed of metal (e.g., SUS, etc.). The elastic member 15 is regarded as a portion of the connecting member 9 in the present embodiment.

A concave portion 16 for covering (housing) a portion of the elastic member 15 is formed on the upper surface of the insulator 8*a* with which the elastic member 15 is partially in contact, and a receiving member 17 formed of metal (e.g., SUS, etc.) for preventing the insulator 8*a* formed of a non-conductive resin from being damaged by receiving the elastic member 15 is provided on a bottom of the concave portion 16 (i.e., a seat portion with which the elastic member 15 is partially in contact).

The receiving member 17 prevents damage of the insulator 8*a* by dispersing stress applied from the elastic member 15 to the upper surface of the insulator 8*a*. Therefore, a contact area between the receiving member 17 and the insulator 8*a* is preferably as large as possible. The receiving member 17 having a shape in contact throughout the entire surface of the bottom of the concave portion 16 is provided in the present embodiment in order to increase the contact surface between the receiving member 17 and the insulator 8*a*.

The connecting member 9 is inserted into the first terminal housing 5 from a side of the surfaces of the first connecting terminals 4*a*-4*c* on which the first insulating members 43*a*-45*a* are fixed (from an upper side in FIG. 4) and the male screw 48 formed on the small diameter portion 9*b* is then joined together with the female screw 47 formed on the connecting member insertion hole 26, which results in that the plural first connecting terminals 4*a*-4*c* and the plural second connecting terminals 6*a*-6*c* are collectively fixed and electrically connected at each contact point by pressure in an insertion direction of the connecting member 9 (from the upper side to the lower side in FIG. 4).

The first terminal housing 5 is formed of a hollow cylindrical body 20 having a substantially rectangular shaped horizontal cross-section. An outer periphery of one side (on the right side in the drawing) of the cylindrical body 20 which is fitted to the second terminal housing 7 is formed in a tapered shape in light of fitting properties to the second connector portion 3. Meanwhile, a rib 12 for stabilizing the fitting direction when fitted to the second terminal housing 7 as well as for fixation and stabilization after fitting is formed on the outer peripheral portion of the cylindrical body 20. In addition, a terminal housing waterproof structure 21 for sealing between the first connector portion 2 and the second connector portion 3 is provided on the outer peripheral portion of the one side of the cylindrical body 20. The terminal housing waterproof structure 21 is composed of a concave portion 22 formed on the outer peripheral portion of the cylindrical body 20 on the opening side and a packing 23 such as an O-ring provided on the concave portion 22.

The first inner housing 10 in which the first connecting terminals 4*a*-4*c* are each aligned and held is housed in the cylindrical body 20 on the other side (on the left side in the drawing). A flange 24 for fixing the first connector portion 2 to a housing of a device, etc., (e.g., a shield case of a motor) is formed on an outer periphery of the other side of the cylindrical body 20. A packing, etc., for sealing between the housing of the device, etc., and the first connector portion 2 may be provided on a peripheral edge portion 25 of the flange 24 which is used for fixation to the housing of the device, etc., by inserting a bolt into a mounting hole 24*a*. The configuration of the flange 24 is not based on the premise that the first connector portion 2 is fixed to a housing of a device, etc., and the flange 24 may be alternatively provided on the second connector portion 3 or on both of the first connector portion 2 and the second connector portion 3. In addition, it may be in a free state in which neither the first connector portion 2 nor the second connector portion 3 is fixed to a housing of a device, etc.

Meanwhile, the flange 24 is effective to improve heat dissipation. That is, a surface area of the first terminal housing 5 can be increased by forming the flange 24, and it is thus possible to improve the heat dissipation when heat generated inside the first connector portion 2 (e.g., heat generated at each contact point) is released to the outside through the first terminal housing 5.

The connecting member insertion hole 26 for inserting the connecting member 9 therethough is formed on the upper portion (on the upper side in the drawing) of the cylindrical body 20. The connecting member insertion hole 26 is formed in a cylindrical shape and a diameter of a lower end portion thereof (on the lower side in the drawing) is reduced so as to match the shape of the connecting member 9. The reduced diameter portion contacts with the peripheral edge portion on the lower surface of the large diameter portion 9*a* of the connecting member 9, thereby restricting a stroke of the connecting member 9.

For shielding performance, heat dissipation and weight saving of the connector 1, the cylindrical body 20 is preferably formed of light metal having high electrical and thermal conductivity such as aluminum, but may be formed of resin. When the first terminal housing 5 is formed of a non-conductive resin, the first insulating member 46*a* and the first terminal housing 5 may be integrally molded by the non-conductive resin. In the present embodiment, the cylindrical body 20 is formed of aluminum. By forming the cylindrical body 20 from aluminum as just described, there is an effect that the connecting member 9 can be tightened firmly to the connecting member insertion hole 26 when joined together as compared to the case where the cylindrical body 20 is formed of an insulating resin.

In the present embodiment, since a clearance between the laminated structure and the first terminal housing 5 is designed to be as small as possible in order to downsize the connector 1, it is necessary to ensure insulation between the first terminal housing 5 and the first connecting terminals 4*a*-4*c* to prevent electrical short circuit of the first connecting terminals 4*a*-4*c* via the metallic first terminal housing 5.

Therefore, in the present embodiment, electricity shields 51 are provided on both sides of the first inner housing 10 in which the first connecting terminals 4*a*-4*c* are aligned and held.

Besides the effect of ensuring the insulation, the electricity shield 51 has a function of touch protection for preventing a foreign object such as a hand or a finger from touching the side surfaces of the first connecting terminals 4*a*-4*c*. In other words, the electricity shield 51 provides the effect of ensuring the insulation between the first terminal housing 5 and the first connecting terminals 4*a*-4*c* when the clearance between the laminated structure and the first terminal housing 5 is configured to be small in the extent that a hand or finger does not get in, and provides the effect of preventing the hand or finger from touching the side surfaces of the first connecting terminals 4*a*-4*c* in a non-fitted state while still having some function of ensuring the insulation when the clearance is configured to be large such that a hand or a finger gets in.

Alternatively, the first insulating members 43*a*-45*a* may be formed so as to cover also the side surfaces of the first connecting terminals 4*a*-4*c*, instead of providing the electricity shield 51.

Since it is considered that most of workers who manipulate the connector are adult men, a standard size of a hand or finger of a worker in the present embodiment is that of adult man. In this regard, however, this standard can be, of course, appropriately changes depending on the assumed worker.

Figure 6A:
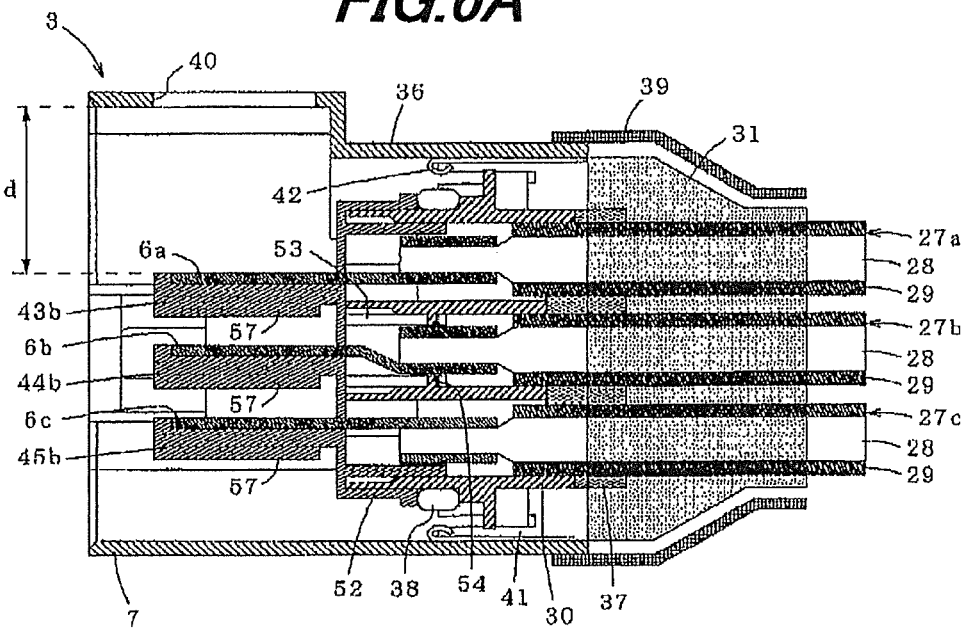
Figure 6B:
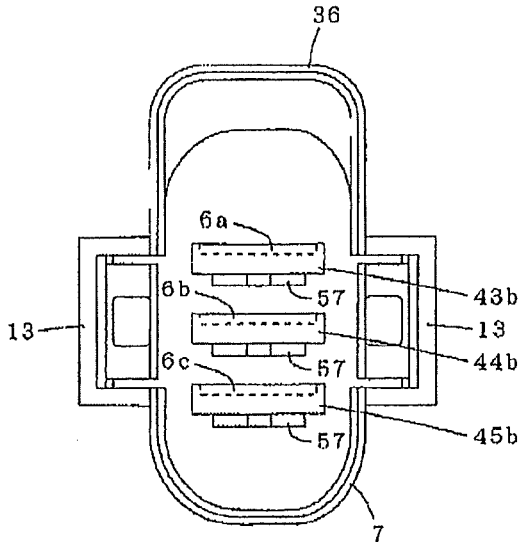

As shown in FIG. 6, the second connector portion 3 has the second terminal housing 7 in which plural (three) aligned second connecting terminals (female terminals) 6*a*-6*c* are housed. Here, a connector portion on a side having female terminals is referred to as the second connector portion 3. In other words, as a terminal housing, the second terminal housing 7 may be either male (a male terminal housing) or female (a female terminal housing). The case where the second terminal housing 7 is a female terminal housing which corresponds to the first terminal housing 5 as a male terminal housing will be explained here.

Figure 7A:
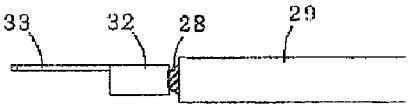
Figure 7B:
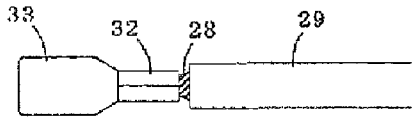
Figure 8A:
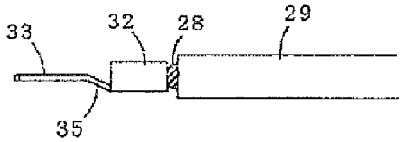
Figure 8B:
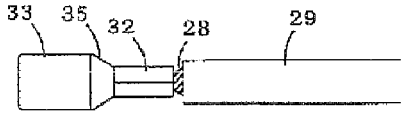
Figure 9A:
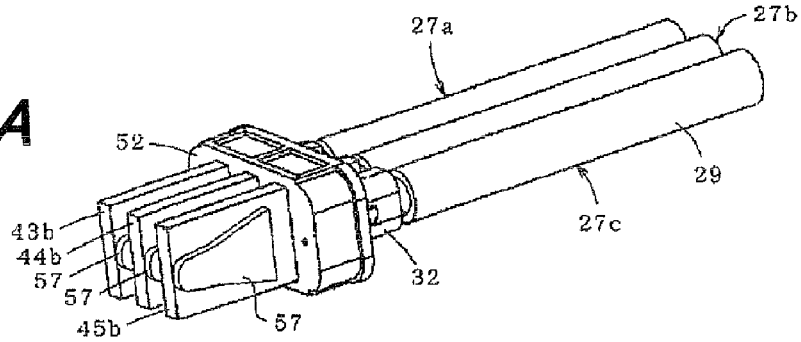
Figure 9B:
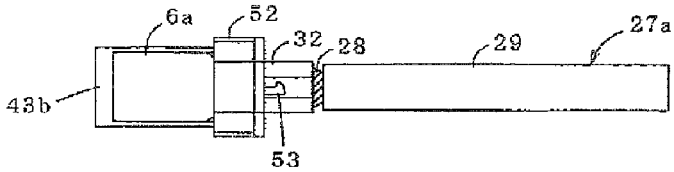
Figure 9C:
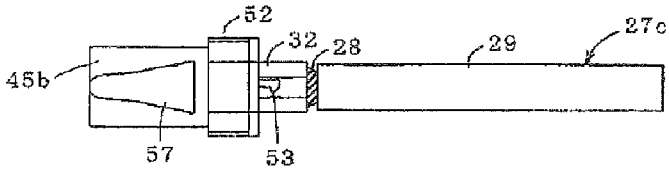
Figure 9D:
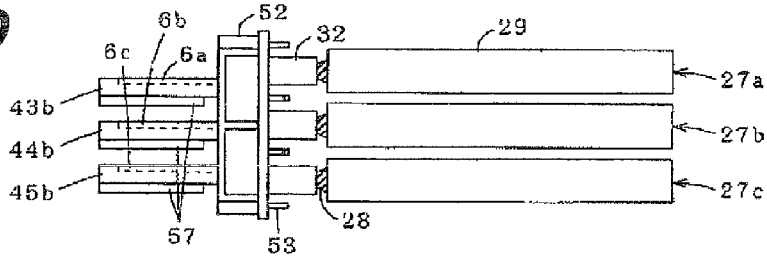

As shown in FIGS. 7 and 8, the second connecting terminals 6*a*-6*c* each have a caulking portion 32 for caulking a conductor 28 which is exposed at an end portion of cables 27*a*-27*c* and a plate-like contact point 33 integrally formed with the caulking portion 32. The end portion of the plate-like contact point 33 may be formed in a tapered shape in order to improve insertability.

The present embodiment is configured such that the cables 27*a*-27*c* are aligned and held with as little clearance as possible in order to downsize the connector 1. Therefore, a trunk portion 35 of the second connecting terminal 6*b* connected to the cable 27*b* which is arranged at the middle when aligned is bent as shown in FIG. 8 so that the second connecting terminals 6*a*-6*c* are arranged at equal intervals.

Each of the second connecting terminals 6*a*-6*c* should be formed of a highly conductive metal such as silver, copper or aluminum for transmission loss reduction, etc., in the connector 1. In addition, each of the second connecting terminals 6*a*-6*c* has little flexibility.

The cables 27*a*-27*c* extending from the inverter side are respectively connected to edges of the second connecting terminals 6*a*-6*c*. The cables 27*a*-27*c* are respectively electrically connected to the first connecting terminals 4*a*-4*c* via the second connecting terminals 6*a*-6*c*, and electricity of different voltage and/or current corresponding to each of the first connecting terminals 4*a*-4*c* is transmitted. The cables 27*a*-27*c* are each composed of the conductor 28 and an insulation layer 29 formed on the outer periphery thereof. The conductor 28 having a cross-sectional area of 20 $mm^2$ is used in the present embodiment.

The cables 27*a*-27*c* are each held by a cable supporting member 30 which is in a multi-cylindrical shape (contiguous plural cylinders). The cable supporting member 30 is formed of a non-conductive resin, etc., to prevent short circuit by insulating the second connecting terminals 6*a*-6*c* from each other. The cable supporting member 30 allows the second connecting terminals 6*a*-6*c* to be held at respective predetermined positions even though each of the cables 27*a*-27*c* respectively connected to the second connecting terminals 6*a*-6*c* is very flexible. In other words, since a cable excellent in flexibility can be used as the cables 27*a*-27*c* in the present embodiment, it is possible to improve the wiring flexibility for laying the cables 27*a*-27*c*.

As shown in FIG. 9, a second inner housing 52 formed of a resin molded body in which the second connecting terminals 6*a*-6*c* connected to the cables 27*a*-27*c* are held so as to be arranged at predetermined intervals is fitted to the end of the cable supporting member 30 in the fitting direction. By the second inner housing 52, the second connecting terminals 6*a*-6*c* are respectively positioned and held under the first connecting terminals 4*a*-4*c* (i.e., objects to be connected) respectively facing the second connecting terminals 6*a*-6*c* so as to be respectively paired therewith when the first connector portion 2 is fitted to the second connector portion 3.

A holding method using insert molding, in the same manner as holding the first connecting terminals 4*a*-4*c* in the first inner housing 10, can be employed as a method of holding the second connecting terminals 6*a*-6*c* in the second inner housing 52.

However, unlike the case of first connecting terminals 4*a*-4*c*, the second connecting terminals 6*a*-6*c* are connected to the long cables 27*a*-27*c* and if the method in which the second connecting terminals 6*a*-6*c* are preliminarily held in the second inner housing 52 by the insert molding is employed, it is necessary to insert the second inner housing 52 from the rear end side of the cables 27*a*-27*c* to fit to the cable supporting member 30, which is cumbersome.

Therefore, in the present embodiment, after the ends of the cables 27*a*-27*c* are inserted into and held in the cable supporting member 30, the second inner housing 52 formed in a cap-like shape is fitted to the cable supporting member 30 so as to cover the second connecting terminals 6*a*-6*c*, thereby aligning and holding the second connecting terminals 6*a*-6*c*.

Meanwhile, a pawl portion 53 to be engaged with the cable supporting member 30 is formed on the second inner housing 52. The pawl portion 53 is engaged with an engaging portion 54 formed on the cable supporting member 30, and the second inner housing 52 is thereby fitted and subsequently fixed to the cable supporting member 30.

The second inner housing 52 is formed of a non-conductive resin, etc., and insulates the second connecting terminals 6*a*-6*c* from each other to prevent short-circuit.

Meanwhile, the second connecting terminals 6*a*-6*c* are integrally fixed to the respective second insulating members 43*b*-45*b* which are adjacently arranged on another surface thereof (a surface opposite to the surface connected to first connecting terminals 4*a*-4*c*). Fixation here means that a positional relationship between the second insulating members 43*b*-45*b* and the second connecting terminals 6*a*-6*c* is fixed, as mentioned previously. The second insulating members 43*b*-45*b* are integrally formed with the second inner housing 52 in the present embodiment. This allows the manufacturing cost to be reduced.

Meanwhile, the second insulating members 43*b*-45*b* are formed so as to cover not only the end surface of the second connecting terminals 6*a*-6*c* on the front end side in the fixing direction but also the side surface thereof. As a result, it is possible to ensure the insulation between the second connecting terminals 6*a*-6*c* and the metallic first terminal housing 5 when the first terminal housing 5 is fitted to the second terminal housing 7. The effect of touch protection is also obtained by covering the side surfaces of the second connecting terminals 6*a*-6*c* in the same manner as the electricity shield 51.

A convex portion 57 fitting to the fitting groove 55 is formed on the lower surfaces (surfaces on the lower side in FIG. 6) of the second insulating members 43*b*-45*b*. The convex portion 57 is formed so that a width thereof is reduced toward the front end side in the fitting direction to be fitted to the fitting groove 55 with substantially no clearance and that the shape of the convex portion 57 is substantially the same as that of the fitting groove 55.

A braided shield 31 is wound around portions of the cables 27*a*-27*c* which are pulled out from the second terminal housing 7 in order to improve the shielding performance. The braided shield 31 is in contact with the below-described cylindrical shield body 41, and is electrically connected to the first terminal housing 5 via the cylindrical shield body 41 (the same potential (GND)). It should be noted that the braided shield 31 is not shown in FIGS. 1 and 2 for simplification.

Referring once again to FIG. 6, the second terminal housing 7 is composed of a hollow cylindrical body 36 having a substantially rectangular horizontal cross section. Since the first terminal housing 5 is fitted in the second terminal housing 7, an inner peripheral portion of the cylindrical body 36 on one side (on the left side in the drawing) to be fitted to the first terminal housing 5 is formed in a tapered shape in light of fitting properties to the first terminal housing 5. Meanwhile, a fixing guide portion 13, by which the rib 12 formed on the cylindrical body 20 composing the first terminal housing 5 is received and guided to be fitted and fixed, is formed on the outer peripheral portion of the cylindrical body 36. The first terminal housing 5 is housed in and fitted to the second terminal housing 7 while the rib 12 is guided by the fixing guide portion 13, which allows smooth fitting, firm fixation after the fitting and prevention of looseness in fitting due to vibration.

Alternatively, the second terminal housing 7 may be configured to be fixed in the first terminal housing 5 in an opposite manner. In this case, the inner peripheral portion of one end of the cylindrical body 20 composing the first terminal housing 5 is formed in a tapered shape, the outer peripheral portion of one end of the cylindrical body 36 composing the second terminal housing 7 is formed in a tapered shape, and the terminal housing waterproof structure 21 is formed on the outer peripheral portion of the one end of the cylindrical body 36.

The cable supporting member 30 having cables 27*a*-27*c* aligned and held therein is housed in the cylindrical body 36 on the other end side (on the right side in the drawing). A non-packing airtight portion 37 is formed on the cable supporting member 30 on a cable insertion side to prevent water from trickling down through the cables 27*a*-27*c* and entering into the second terminal housing 7. A packing 38 in contact with an inner peripheral surface of the first terminal housing 5 is provided between the cable supporting member 30 and the second inner housing 52 on the outer peripheral portion of the cable supporting member 30. That is, the connector 1 has a double waterproof structure composed of the packing 23 of the terminal housing waterproof structure 21 and the packing 38 provided on the outer peripheral portion of the cable supporting member 30.

Furthermore, the outer periphery of the cylindrical body 36 on the other end side from where the cables 27*a*-27*c* are led out is covered by a rubber boot 39 for preventing water from entering into the cylindrical body 36. It should be noted that the rubber boot 39 is not shown in FIGS. 1 and 2 for simplification.

A connecting member manipulating hole 40, through which the connecting member 9 provided on the first connector portion 2 is manipulated when the second connector portion 3 is fitted to the first connector portion 2, is formed on an upper portion of the cylindrical body 36 (on the upper side in the drawing). The connecting member manipulating hole 40 also serves as a through-hole for making the connecting member 9 insertable into and extractable from the first terminal housing 5 after the first terminal housing 5 is fitted to the second terminal housing 7. The function as the through-hole allows easy assembly and maintenance of the connector 1, and provides an effect of good usability. The connecting member 9 can be pulled out through the connecting member manipulating hole 40 to repair or replace the packing 14 without detaching the second connector portion 3 from the first connector portion 2 even if, e.g., the packing 14 provided on the connecting member 9 has to be replaced due to corrosion caused by deterioration with time.

For shielding performance, heat dissipation and weight saving of the connector 1, the cylindrical body 36 is preferably formed of light metal having high electrical and thermal conductivity such as aluminum, but may be formed of resin. Since the cylindrical body 36 is formed of a non-conductive resin in the present embodiment, the aluminum cylindrical shield body 41 is provided on an inner peripheral surface of the cylindrical body 36 on the other end side in order to improve the shielding performance and the heat dissipation.

The cylindrical shield body 41 has a contact portion 42 which comes in contact with an outer periphery of the aluminum first terminal housing 5 when the first connector portion 2 is fitted to the second connector portion 3, and the cylindrical shield body 41 and the first terminal housing 5 are thermally and electrically connected via the contact portion 42. This improves the shielding performance and the heat dissipation. Significant improvement is expected particularly in the heat dissipation by actively releasing heat to the first terminal housing 5 which is excellent in heat dissipation.

Connection between the first connecting terminals 4*a*-4*c* and the second connecting terminals 6*a*-6*c* using the connector 1 of the present embodiment will be described below.

When the first connector portion 2 is fitted to the second connector portion 3, the second connecting terminals 6*a*-6*c* and the second insulating members 43*b*-45*b* are respectively inserted into gaps between the first connecting terminals 4*a*-4*c* and the first insulating members 43*a*-46*a* which are paired therewith. The insertion provides a laminated structure in which one surface of each of the plural first connecting terminals 4*a*-4*c* faces one surface of each of the plural second connecting terminals 6*a*-6*c* so as to be paired, and the first connecting terminals 4*a*-4*c* and the second connecting terminals 6*a*-6*c* and the insulators 8*a*-8*d* formed by overlapping the first insulating members 43*a*-46*a* with the second insulating members 43*b*-45*b* are alternately arranged.

Since both of the fitting groove 55 and the convex portion 57 are formed in a substantially triangular shape, the fitting groove 55 is gradually fitted into the convex portion 57 in this process as the first terminal housing 5 is being fitted to the second terminal housing 7. That is, at an early stage of the fitting operation, a small width portion of the convex portion 57 on the front end side in the fitting direction thereof is inserted into a large groove width portion of the fitting groove 55 on the front end side in the fitting direction thereof and a clearance between the fitting groove 55 and the convex portion 57 is large, which allows the first insulating members 44*a*-46*a* and the second insulating members 43*b*-45*b* to move freely with respect to one another, and at a late stage of the fitting operation, the clearance between the fitting groove 55 and the convex portion 57 is gradually reduced which results in that the first insulating members 44*a*-46*a* and the second insulating members 43*b*-45*b* cannot move with respect to one another and are being fixed.

In the present embodiment, particularly, since the necked portion 56 is formed in the fitting groove 55 on the rear end side in the fitting direction so that the convex portion 57 is fitted to the fitting groove 55 without clearance, a width difference between the fitting groove 55 on the front end side in the fitting direction thereof and the convex portion 57 on the front end side in the fitting direction thereof can be increased at the early stage of the fitting operation as compared to the case where the fitting groove 55 and the convex portion 57 are formed in a simple triangular shape without necked portion. As a result, the first insulating members 44*a*-46*a* and the second insulating members 43*b*-45*b* can move more freely at the early stage of the fitting operation and it is possible to ensure sufficient insertability of the first connecting terminals 4*a*-4*c* into the second connecting terminals 6*a*-6*c*. At the late stage of the fitting operation, the convex portion 57 can be securely held at the necked portion 56 of the fitting groove 55 and the first insulating members 44*a*-46*a* are firmly fixed to the second insulating members 43*b*-45*b*.

At this time, in the first connector portion 2, the first insulating members 43*a*-46*a* and the second insulating members 43*b*-45*b* which compose the insulators 8*a*-8*d* are respectively fixed to the ends of the first connecting terminals 4*a*-4*c* and the second connecting terminals 6*a*-6*c* aligned and held at predetermined intervals and to the first terminal housing 5, each gap between the insulators 8*a*-8*d* can be kept without additionally providing a retention jig for keeping gaps between the insulators 8*a*-8*d*. This makes easy to respectively insert the second connecting terminals 6*a*-6*c* and the second insulating members 43*b*-45*b* into gaps between first connecting terminals 4*a*-4*c* and first insulating members 43*a*-46*a* which are respectively paired therewith. In other words, the insertion and extraction properties of the second connecting terminals 6*a*-6*c* are not degraded. In addition, it is very effective in that it is possible to realize further downsizing as compared to the conventional art since it is not necessary to provide a retaining jig for keeping the gaps between the insulators 8*a*-8*d*.

Meanwhile, a contact point between the first connecting terminal 4*a* (or 4*b*) and the second connecting terminal 6*a* (or 6*b*) is sandwiched between the insulator 8*a* (or 8*b*) and the insulator 8*b* (or 8*c*). Likewise, a contact point between the first connecting terminal 4*c* and the second connecting terminal 6*c* is sandwiched between the insulator 8*c* and the insulator 8*d*.

After that, as shown in FIG. 3, when the male screw 48 of the connecting member 9 and the female screw 47 of the first terminal housing 5 are joined together and tightened by manipulating the connecting member 9 through the connecting member manipulating hole 40, the connecting member 9 is turned and pushed into the first terminal housing 5, and then, the insulator 8*a*, the insulator 8*b*, the insulator 8*c* and the insulator 8*d* are pressed in this order by the elastic member 15 so that any two of the insulators 8*a*-8*d* sandwich each contact point and come in contact therewith in a state that the contact points are insulated from each other. At this time, the first connecting terminals 4*a*-4*c* and the second connecting terminals 6*a*-6*c* are bent in some degree due to pressure from the insulators 8*a*-8*d* and respectively make contact in a large area. As a result, it is possible to realize a connector which is effective particularly for a vehicle in which vibration is likely to occur.

In sum, as described above, in the connector 1 of the present embodiment, since the fitting groove 55 is formed on one of facing surfaces of the first insulating member 44*a* (or 45*a* or 46*a*) and the second insulating member 43*b* (or 44*b* or 45*b*) which face each other when the two divided insulators (the first insulating members 44*a*-46*a* and the second insulating members 43*b*-45*b*) are overlapped and the convex portion 57 fitted to the fitting groove 55 is formed on the another facing surface, it is possible to restrict movement of each insulating member and to suppress abrasion due to fine sliding at the contact points while ensuring insertability between connecting terminals when the connector is fitted even if a non-through type connecting member is employed.

Additionally, in the connector 1, since the insulators 8*a*-8*d* for insulating each contact point are composed of two divided insulators, the first insulating members 43*a*-46*a* and the second insulating members 43*b*-45*b*, which are respectively fixed to the other surfaces of the first connecting terminals 4*a*-4*c* and the second connecting terminals 6*a*-6*c*, not only the first connecting terminals 4*a*-4*c* but also the second connecting terminals 6*a*-6*c* are not exposed in the non-fitted state and it is thereby possible to prevent unintentional contact and electric shock to a foreign object such as a hand or finger of a worker, etc.

In addition, in the connector 1 of the present embodiment, the insulators 8*a*-8*d* having a predetermined thickness are formed by the overlap of the first insulating members 43*a*-46*a* and the second insulating members 43*b*-45*b* when the first terminal housing 5 is fitted to the second terminal housing 7. In other words, the insulators 8*a*-8*d* are formed in a thickness necessary and sufficient for insulation between terminals or between each terminal and the first terminal housing 5. Therefore, a lamination thickness of the laminated structure composed of the respective contact point and the insulators 8*a*-8*d* does not become unintentionally large.

Although the thicknesses of the first insulating members 43*a*-46*a* are substantially the same as those of the second insulating members 43*b*-45*b* in the present embodiment, the thicknesses may be different. That is, for example, the second insulating members 43*b*-45*b* may be formed thinner than the first insulating members 43*a*-46*a* to improve flexibility of the second connecting terminals 6*a*-6*c* to which the second insulating members 43*b*-45*b* are fixed. In other words, the invention is applicable not only to a connector aiming to downsize but also to a conventional connector.

It should be noted that the present invention is not intended to be limited to the above-mentioned embodiments, and the various kinds of embodiments can be implemented without departing from the gist of the present invention.

In the present embodiment, for example, the fitting groove 55 is formed on the first insulating members 44*a*-46*a* and the convex portion 57 is formed on the second insulating members 43*b*-45*b*, however, it may be configured such that the convex portion 57 is formed on the first insulating members 44*a*-46*a* and the fitting groove 55 is formed on the second insulating members 43*b*-45*b*.

Figure 10:
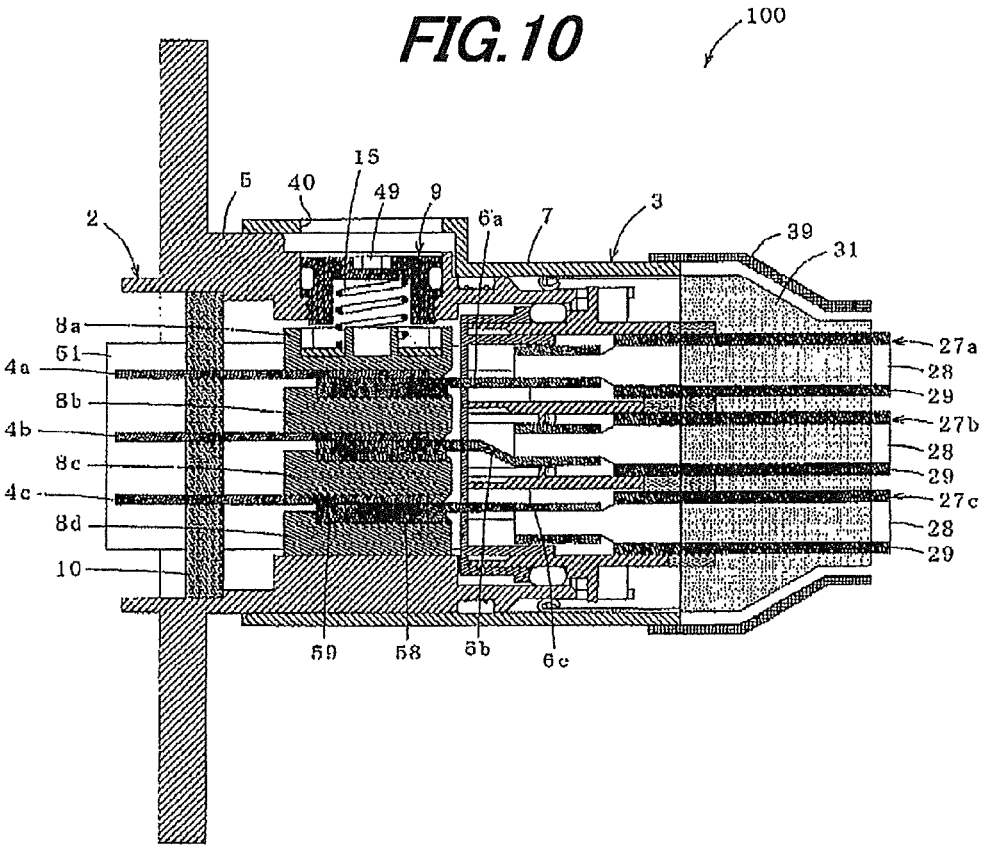
FIG. 10 is a perspective view showing first and second connector portions which compose a connector in a modification.
Figure 11A:
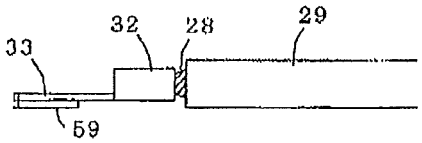
Figure 11B:
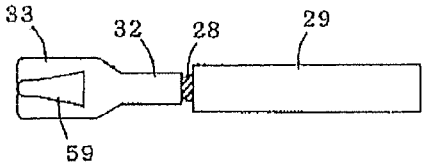

In addition, although the insulators 8*a*-8*d* are each divided in the present embodiment, the invention is applicable to a connector 100 using insulators 8*a*-8*d* which are each one-piece and not divided, as shown in FIG. 10. In this case, for example, the insulators 8*a*-8*d* are fixed to the first connecting terminals 4*a*-4*c* and to the inner surface of the first terminal housing 5, a fitting groove 58 is formed on each of the insulators 8*a*-8*d*, a convex portion 59 is formed on another surface of each of the second connecting terminals 6*a*-6*c* which faces the fitting groove 58, and the same effect as the connector 1 is thereby obtained.

Figure 12A:
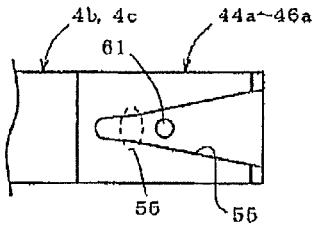
FIGS. 12A and 12B are top views showing shapes of a fitting groove and a convex portion in the modification of the invention.
Figure 12B:
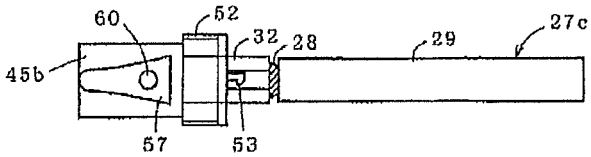

In addition, as shown in FIG. 12, a protruding engaging portion 60 may be formed on a surface of the convex portion 57 while an engaging hole 61 to be engaged with the engaging portion 60 is formed on a bottom surface of the fitting groove 55. This prevents fine sliding in the fitting direction.

Meanwhile, the present embodiment assumes the use of a three-phase AC power line, however, according to the technical idea of the invention, it may be, e.g., a connector for a vehicle which is configured to collectively connect lines used for different purposes such as a three-phase AC power line between a motor and a vehicle and a two-phase DC power line for air conditioner. Since the configuration described above allows one connector to collectively connect power lines used for different purposes, it is not necessary to prepare different connectors for each intended purpose and it is thus possible to contribute to space saving and cost reduction.

In addition, although the first connecting terminals 4*a*-4*c* are respectively in surface-to-surface contact with the second connecting terminals 6*a*-6*c* in the present embodiment, it may be configured that a protruding portion is each formed on surfaces of the first connecting terminals 4*a*-4*c* which are the contact side surface and are in contact with the second connecting terminals 6*a*-6*c*, and the protruding portion is fitted to the plate-like contact point 33 of the second connecting terminals 6*a*-6*c*. Each combining force between the first connecting terminals 4*a*-4*c* and the second connecting terminals 6*a*-6*c* can be more stabilized by the above-mentioned configuration. That is, it is particularly effective against vibration in a direction perpendicular to the connecting member 9.

Alternatively, terminal surfaces of the first connecting terminals 4*a*-4*c* and the second connecting terminals 6*a*-6*c* may be each roughened by a knurling process to increase frictional force so as to make the terminals difficult to move, thereby strengthening the fixation at each contact point.

Meanwhile, although the first connecting terminals 4*a*-4*c* are linearly in contact with the second connecting terminals 6*a*-6*c* when viewed from the large diameter portion 9*a* side of the connecting member 9 in the present embodiment, the first terminal housing 5 and the second terminal housing 7 may be configured so that the first connecting terminals 4*a*-4*c* of the first connector portion 2 respectively in contact with the second connecting terminals 6*a*-6*c* of the second connector portion 3 are crossed at a right angle when viewed from the large diameter portion 9*a* side of the connecting member 9. In other words, the first connector portion 2 and the second connector portion 3 may be fitted in an L-shaped manner. Likewise, it is possible to configure so that the second terminal housing 7 and the second connecting terminals 6*a*-6*c* are arranged obliquely with respect to the first terminal housing 5 and the first connecting terminals 4*a*-4*c*. By applying the aspect of the invention as described above, the insertion and extraction direction of the second connector portion 3 into and from the first connector portion 2 can be diversified. In other words, a direction of leading a cable from a connector can be adjusted to a desired direction, thereby contributing to space saving.

In addition, the case where a cable is not connected to one end of the first connecting terminals 4*a*-4*c*, unlike the second connecting terminals 6*a*-6*c*, has been described in the present embodiment, it is not limited to such a structure. That is, the connector of the present embodiment can be used for connecting between cables.

In addition, although a cable excellent in flexibility is used as the cables 27*a*-27*c* in the present embodiment, a rigid cable may be used.

In addition, the connecting member 9 having the irregular shaped hole 49 has been explained as an example in the present embodiment, the configuration of the connecting member 9 is not intended to be limited to the form in which the irregular shaped hole 49 is formed, and, for example, a stem of a CPA (Connector Position Assurance) lever for securing the fitting of the first connector portion 2 and the second connector portion 3 may be configured as the connecting member 9 so that the fitting is secured by rotating the CPA lever and the connecting member 9 is pressed (or tightened) toward the first terminal housing 5.

In addition, although the connecting member 9 in which the irregular shaped hole 49 for fitting a hexagonal wrench (also called hexagonal spanner) is formed on the upper surface of the large diameter portion 9*a* is used in the present embodiment under an assumption of using a commercially available hexagonal wrench, it may be configured such that an irregular shaped hole 49 in a shape corresponding to that of a specialized tool is formed on the upper surface of the large diameter portion 9*a* under an assumption of using a specialized tool of which shape is not commercially available.

In addition, in the present embodiment, a direction of the connecting member 9 may be either horizontal or vertical when the connector is in use. In other words, a direction in a usage state is not a requirement in the use conditions of the connector of the present embodiment.

In addition, although the connecting member 9 presses the insulator 8*a* adjacent thereto via the elastic member 15 which is a portion of the connecting member 9 in the present embodiment, the adjacent insulator 8*a* may be pressed directly, not via the elastic member 15.

Note that, although it is mentioned that use of the connecting member 9 which is not the through type provides an effect of reducing the cost as compared to the case of using the through type connecting member 9, employing the non-through type connecting member 9 leads to weight saving of the connecting member 9, which can contribute to weight saving of the entire connector 1 as a result.

Although the invention has been described with respect to the specific embodiment for complete and clear disclosure, the appended claims are not to be therefore limited but are to be construed as embodying all modifications and alternative constructions that may occur to one skilled in the art which fairly fall within the basic teaching herein set forth.

What is claimed is:

1. A connector, comprising:

a first terminal housing for housing a plurality of aligned first connecting terminals;

a second terminal housing for housing a plurality of aligned second connecting terminals;

a laminated structure that one surface of each of the plurality of first connecting terminals is paired with one surface of each of the plurality of second connecting terminals to form a plurality of contact points when the first terminal housing is fitted to the second terminal housing and each contact point is arranged so as to be sandwiched by insulators having a predetermined thickness; and a connecting member for collectively fixing and electrically connecting the plurality of first connecting terminals and the plurality of second connecting terminals at each contact point by pressing the insulator adjacent thereto, wherein the insulator comprises a first insulating member that is one of two divided insulators formed by dividing the insulator, the first insulating member being formed so as to be fixed to another surface of the first connecting terminal adjacent thereto and to cover at least an end surface of the adjacent first connecting terminal on a front end side in a fitting direction, and a second insulating member that is another of the divided insulators, the second insulating member being formed so as to be fixed to another surface of the second connecting terminal adjacent thereto and to cover at least an end surface of the adjacent second connecting terminal on a front end side in a fitting direction, the two divided insulators overlap when the first terminal housing is fitted to the second terminal housing, thereby forming the insulator having a predetermined thickness, and a fitting groove is formed on a facing surface of one of the first and second insulating members that face each other by the overlap of the two divided insulators, and a convex portion fitting to the fitting groove is formed on a facing surface of the other.

2. The connector according to claim 1, wherein a protruding engaging portion is formed on a surface of the convex portion, and an engaging hole to be engaged with the engaging portion is formed on a bottom surface of the fitting groove.

3. The connector according to claim 1, wherein the fitting groove is formed in a triangular shape such that a groove width increases toward a front end side in a fitting direction, the convex portion is formed such that a width decreases toward the front end side in the fitting direction so as to be fitted to the triangular fitting groove, and the fitting groove is gradually fitted into the convex portion as the first terminal housing is being fitted to the second terminal housing.

4. The connector according to claim 3, wherein a protruding engaging portion is formed on a surface of the convex portion, and an engaging hole to be engaged with the engaging portion is formed on a bottom surface of the fitting groove.

5. A connector, comprising:

a first terminal housing for housing a plurality of aligned first connecting terminals;

a second terminal housing for housing a plurality of aligned second connecting terminals;

a plurality of aligned insulators housed in the first terminal housing;

a laminated state that one surface of each of the plurality of first connecting terminals faces one surface of each of the plurality of second connecting terminals so as to be paired when the first terminal housing is fitted to the second terminal housing and the plurality of insulators are arranged so that each of a plurality of contact points formed by a plurality of facing first and second connecting terminals are sandwiched therebetween; and a connecting member for collectively fixing and electrically connecting the plurality of first connecting terminals and the plurality of second connecting terminals at each contact point by pressing the insulator adjacent thereto is included, wherein each of the plurality of first connecting terminals is integrally fixed to an insulator that is adjacently arranged on another surface, and a fitting groove is formed on one of another surface of the second connecting terminal and a surface of the insulator that face each other at the time of fitting the first terminal housing to the second terminal housing, and a convex portion fitting to the fitting groove is formed on the other.

6. The connector according to claim 5, wherein a protruding engaging portion is formed on a surface of the convex portion, and an engaging hole to be engaged with the engaging portion is formed on a bottom surface of the fitting groove.

7. The connector according to claim 5, wherein the fitting groove is formed in a triangular shape such that a groove width increases toward a front end side in a fitting direction, the convex portion is formed such that a width decreases toward the front end side in the fitting direction so as to be fitted to the triangular fitting groove, and the fitting groove is gradually fitted into the convex portion as the first terminal housing is being fitted to the second terminal housing.

8. The connector according to claim 7, wherein a protruding engaging portion is formed on a surface of the convex portion, and an engaging hole to be engaged with the engaging portion is formed on a bottom surface of the fitting groove.

* * * * *